US010543140B2

(12) United States Patent
Kunysz

(10) Patent No.: US 10,543,140 B2
(45) Date of Patent: Jan. 28, 2020

(54) INDEPENDENT NEONATAL SUPPORT ASSESSMENT PLACENTA TRANSFUSION AND RESUSCITATION UNIT

(71) Applicant: Zenon Kunysz, Calgary (CA)

(72) Inventor: Zenon Kunysz, Calgary (CA)

( * ) Notice: Subject to any disclaimer, the term of this patent is extended or adjusted under 35 U.S.C. 154(b) by 0 days.

(21) Appl. No.: 14/738,058

(22) Filed: Jun. 12, 2015

(65) Prior Publication Data

US 2016/0213540 A1 Jul. 28, 2016

Related U.S. Application Data

(60) Provisional application No. 62/107,572, filed on Jan. 26, 2015.

(51) Int. Cl.
*A61G 11/00* (2006.01)

(52) U.S. Cl.
CPC ..... *A61G 11/002* (2013.01); *A61G 2200/14* (2013.01); *A61G 2210/30* (2013.01)

(58) Field of Classification Search
CPC ..... A61G 11/00; A61G 11/001; A61G 11/002
USPC ..... 600/21–22
See application file for complete search history.

(56) References Cited

U.S. PATENT DOCUMENTS 5,980,449 A * 11/1999 Benson ..... A47C 21/048 600/22
2011/0166411 A1* 7/2011 Richards ..... A61G 11/00 600/22
2013/0217981 A1* 8/2013 Kneuer ..... A61B 5/01 600/301

* cited by examiner

*Primary Examiner* — John P Lacyk

(57) ABSTRACT

A trolley is provided for user in hospital settings, generally related to the maternity ward and newborn infants. The trolley has a height-adjustable platform which is connected to a base structure through a lift mechanism. The lift mechanism is used to raise and lower the height-adjustable platform as desired by an attending physician. To help an attending physician deliver and care for newborn infants, a resuscitation system, vacuum system, and accessory-receiving mount are also provided. Power is provided by a rechargeable battery which is placed in a power housing which is mounted to the base structure. The resuscitation system provides two gas tanks which are connected to a gas mixer and controlled by an associated module. The resuscitation system is able to provide specific gas mixtures for a newborn infant. The vacuum system aides with post birth cleaning, and other devices can be connected to the accessory-receiving mount as needed.

1 Claim, 7 Drawing Sheets

INDEPENDENT NEONATAL SUPPORT ASSESSMENT PLACENTA TRANSFUSION AND RESUSCITATION UNIT

The current application claims a priority to the U.S. Provisional Patent application Ser. No. 62/107,572 filed on Jan. 26, 2015.

FIELD OF THE INVENTION

The present invention relates generally to medical trolleys used for monitoring and caring for patients. More specifically, the present invention is a trolley which is used for infant monitoring. The present invention is used to congregate a number of tools and devices which are needed immediately after a child is born. This allows the child to be kept near the mother such that umbilical nonseverance may be more easily practiced. Moreover, the attachments which can be used with the present invention facilitate monitoring of the infants health, as well as cleaning the infant, keeping it warm, and resuscitating the infant.

BACKGROUND OF THE INVENTION

Immediately after a child is born, a number of steps must be taken to ensure that the infant is healthy. In doing this, the infant is taken from the mother to be weighed, cleaned, and monitored. Each process requires a number of tools or devices. In many hospitals, it is not uncommon for said devices to be kept in different locations. Because of this, time is often wasted in locating or moving tools, or moving the infant. This can be an issue, especially with premature infants, who may not be in good health when they are born. Moreover, relocating the infant can cause anxiety for the mother if they are unable to see what is happening with their child.

Accordingly, there is a present need for a trolley which can be used to congregate all needed tools and devices needed when caring for a newborn infant and keep the infant near the mother at all times. The present invention is a trolley which is used for both saving the lines of newborn infants as well as monitoring said infants' health immediately after birth. It provides a number of features which are useful for monitoring the infant's health, resuscitating the infant, and keeping it warm. The present invention may be easily maneuvered to the bedside and its height may be adjusted based on the needs of the doctor or the mother. The trolley also allows for monitoring equipment to be easily maneuvered such that it does not obstruct access to the infant.

DETAIL DESCRIPTIONS OF THE INVENTION

All illustrations of the drawings are for the purpose of describing selected versions of the present invention and are not intended to limit the scope of the present invention.

Figure 1:
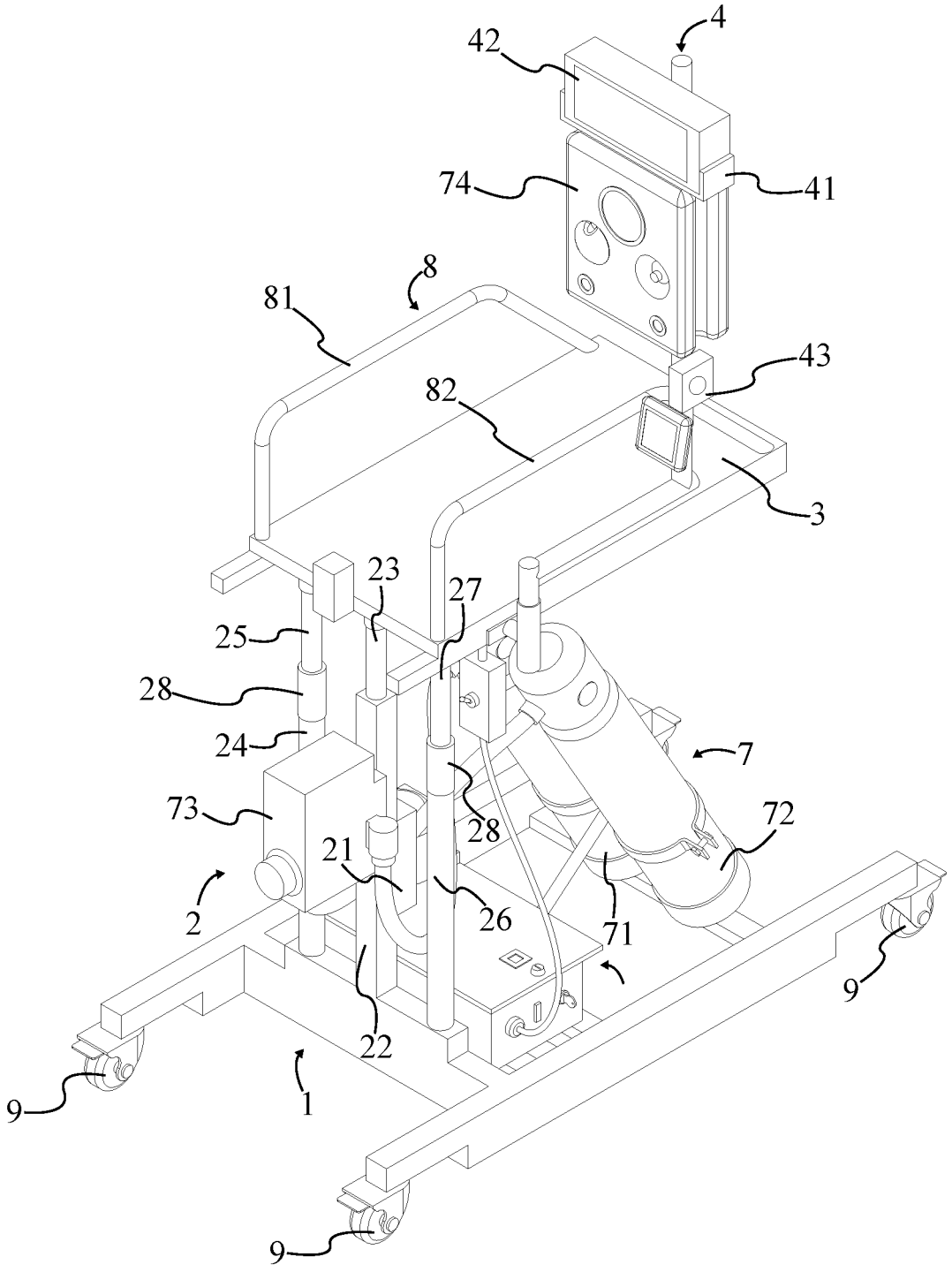
FIG. 1 is a perspective view of the present invention.
Figure 2:
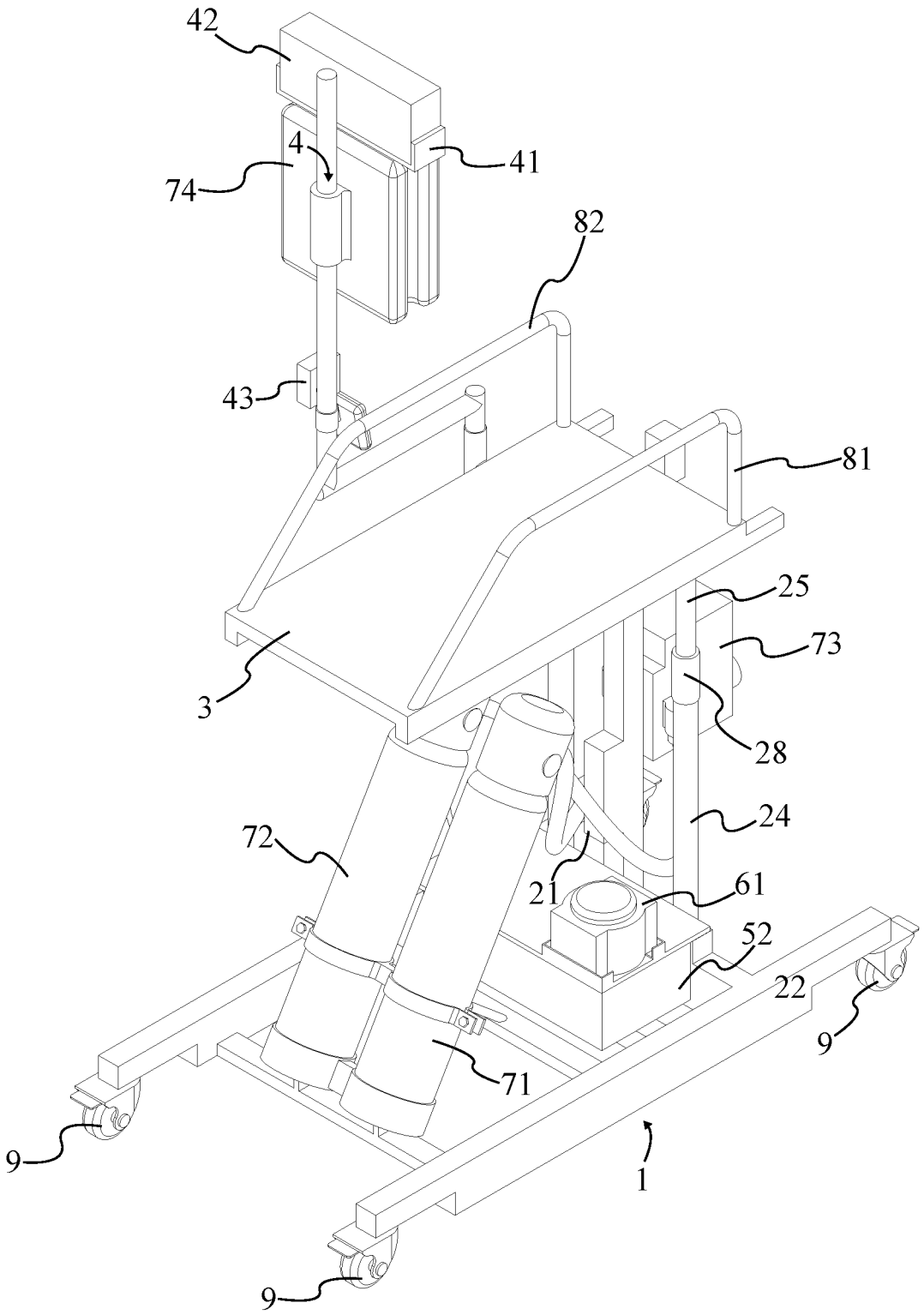
FIG. 2 is a rear perspective view of the present invention.
Figure 3:
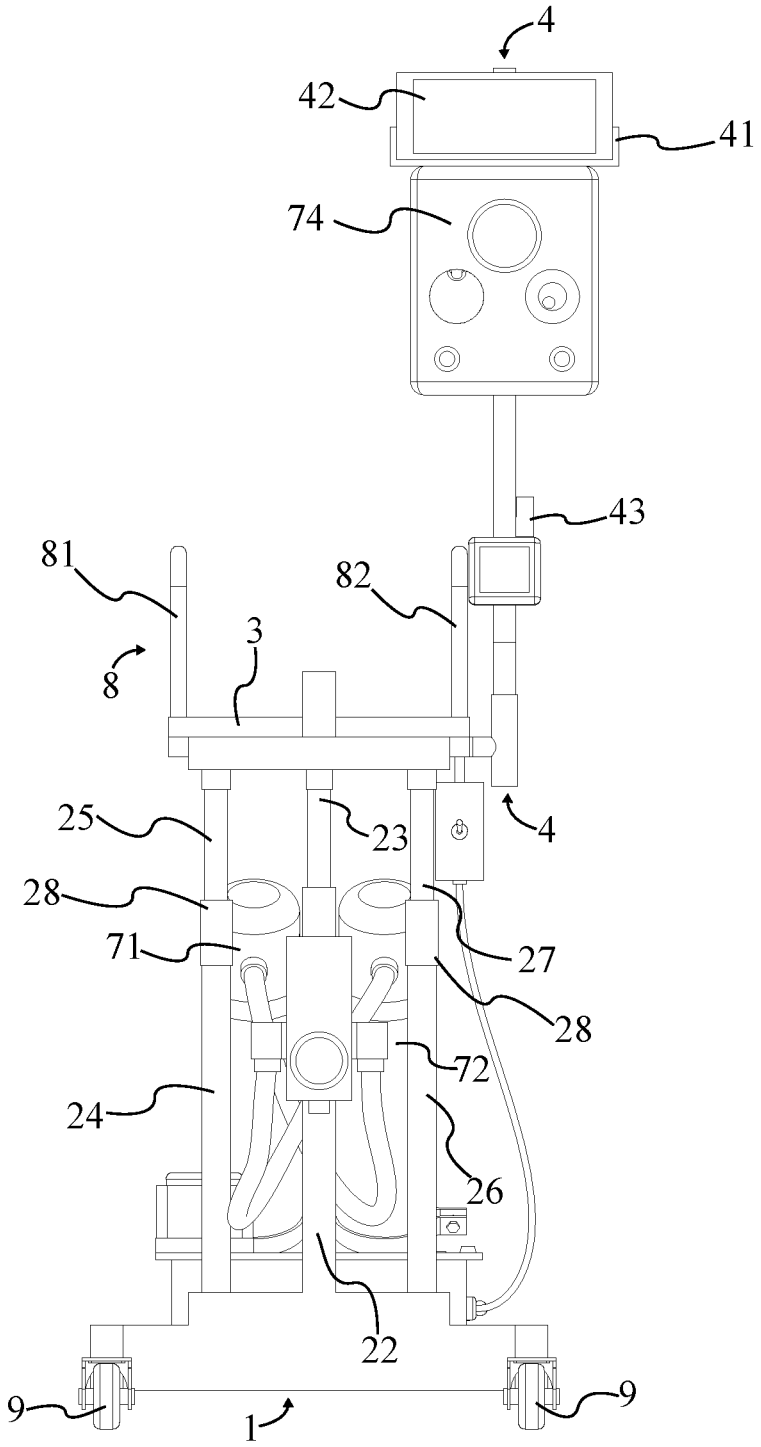
FIG. 3 is a front plane view of the present invention.
Figure 4:
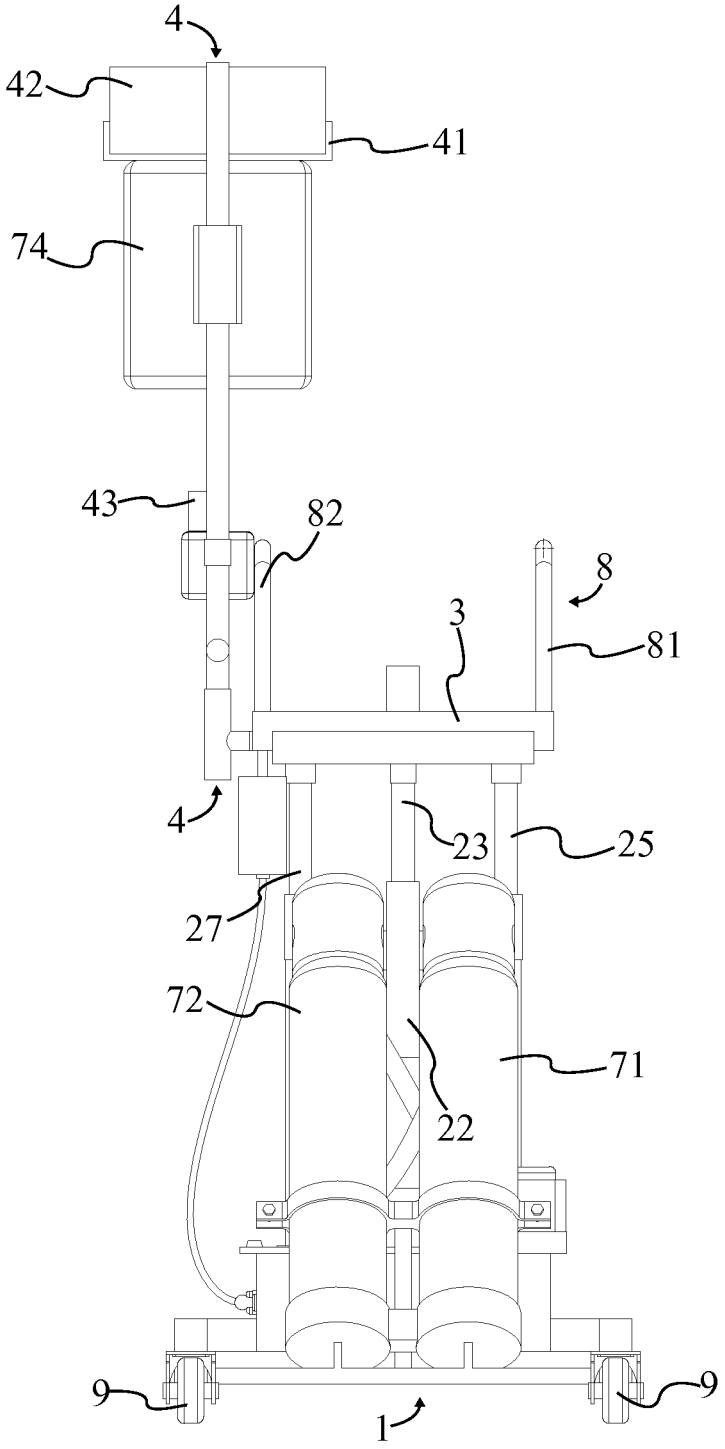
FIG. 4 is a rear plane view of the present invention.
Figure 5:
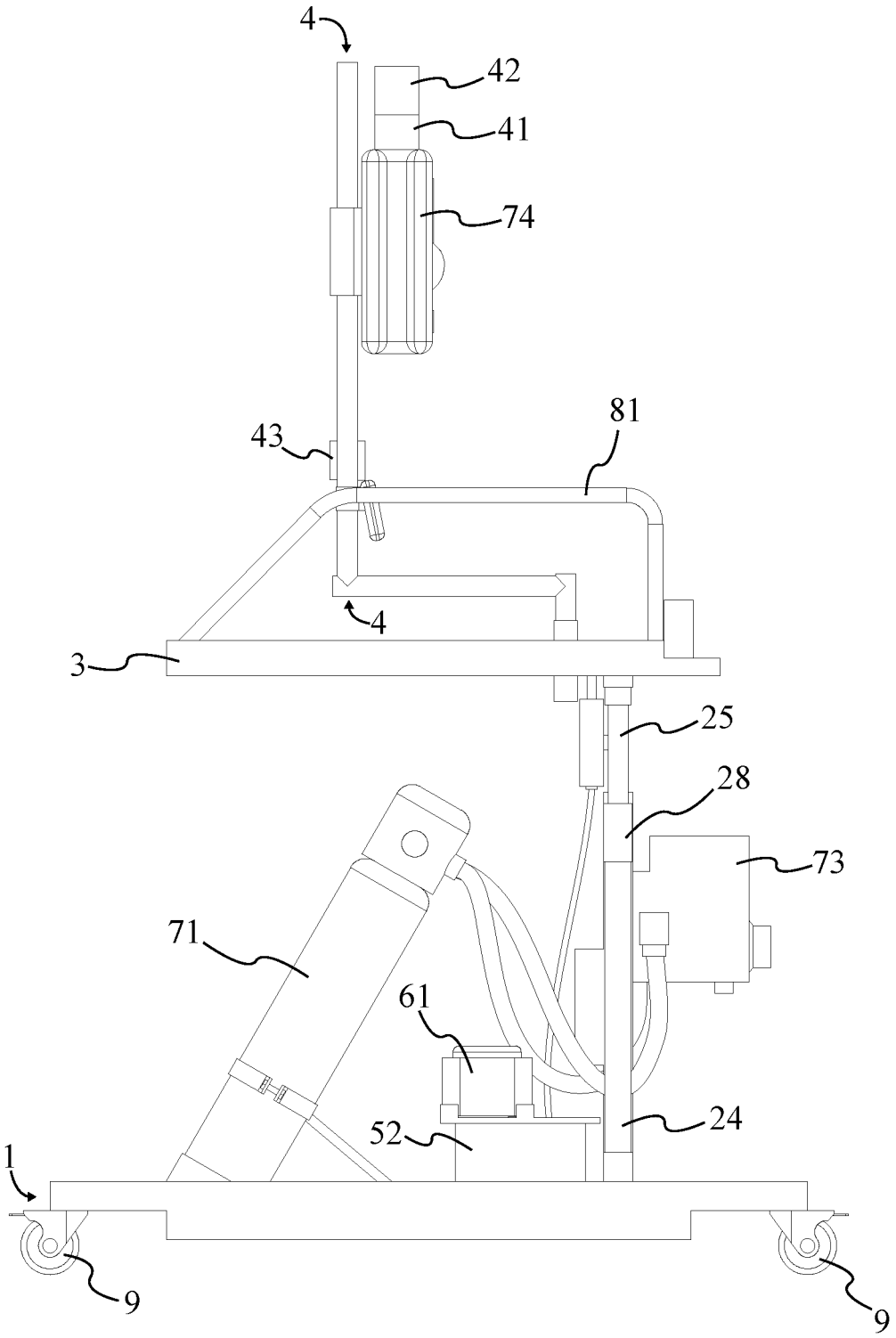
FIG. 5 is a left plane view of the present invention.
Figure 6:
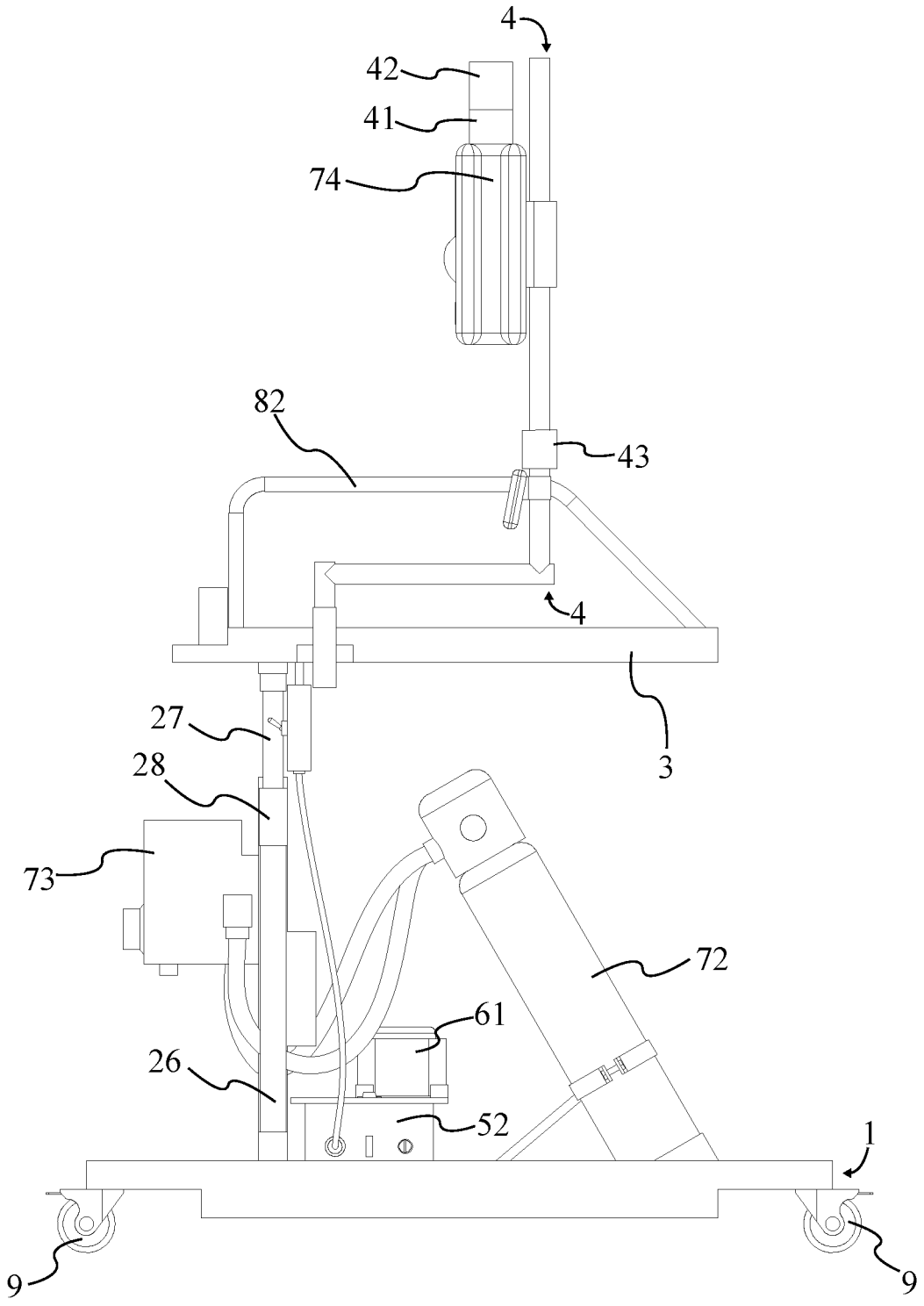
FIG. 6 is a right plane view of the present invention
Figure 7:
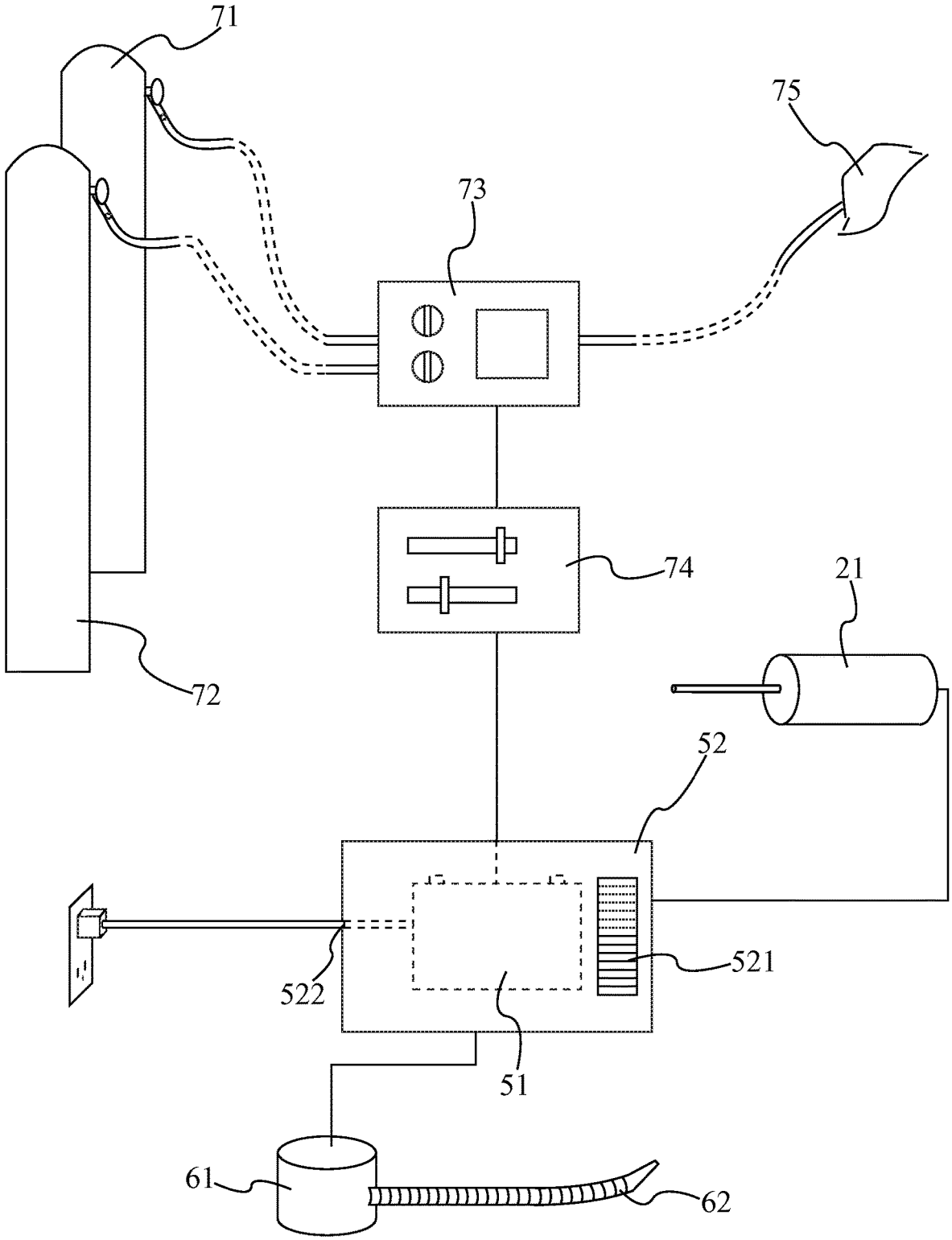
FIG. 7 is a diagram showing connections between systems of the present invention.

The present invention is an independent neonatal support assessment placenta transfusion and resuscitation unit. The present invention is provided for use in hospital settings, especially with respect to maternity wards and other newborn focused departments. The present invention aids with monitoring infants and moving said infants between rooms and departments, as well as being especially useful in helping to save the lives of newborn infants. The present invention comprises a base structure 1, a lift mechanism 2, a height-adjustable platform 3, an accessory-receiving mount 4, a power system 5, a vacuum system 6, and a resuscitation system 7. The height-adjustable platform 3 is connected to the lift mechanism 2, the lift mechanism 2 itself being connected atop the base structure 1. The lift mechanism 2 allows for movement of the height-adjustable platform 3 relative to the base structure 1. As a result, an attending physician can easily set the height-adjustable platform 3 to a desired height. The power system 5 enables operation of the lift mechanism 2, the vacuum pump 61, and the resuscitation system 7 by means of an electrical connection. The present invention is easily moved, allowing it to be maneuvered as needed. For example, it can be maneuvered next to a delivery table, allowing a doctor to examine a newborn infant without having to remove the infant from the mother's presence. The height-adjustable 3 platform is beneficial as it allows a work surface to be raised or lowered to a position that is desirable, for example in the interest of ergonomics (e.g. adjusting for attending physicians with different heights) or practicality. The lift mechanism 2 that drives said height-adjustable platform 3 is subsequently described in more detail. The construction of the present invention is illustrated via FIG. 1-FIG. 6, while FIG. 7 is a diagram illustrating connections between systems of the present invention.

The lift mechanism 2 is a powered component that is capable of raising and lowering the height-adjustable platform 3 as desired by an attending physician. The lift mechanism 2 comprises a drive mechanism 21, a drive track 22, and an anchoring member 23. The drive mechanism 21 engages the anchoring member 23 in order to move said anchoring member 23 up and down along the drive track 22. The anchoring member 23 is slidably engaged with the drive track 22 in order to enable the aforementioned movement. The height-adjustable platform 3 is connected atop the anchoring member 23, with motion of the anchoring member 23 resulting in corresponding motion of the height-adjustable platform 3. Potentially, in order to provide additional clearance between the top of the anchoring member 23 and the adjacent height-adjustable platform 3, a riser can be connected atop the anchoring member 23. The riser extends along an axis shared with the anchoring member 23 and supports the height-adjustable platform 3, being connected between the height-adjustable platform 3 and the anchoring member 23, effectively anchoring the height-adjustable platform 3 to the lift mechanism 2.

To provide additional support, one embodiment of the present invention comprises a first stabilizing track 24 and a second stabilizing track 26 in addition to the drive track 22. Each stabilizing track has a corresponding stabilizing anchor. The configuration of these components is similar to that of the drive track 22 and anchoring member 23, though the drive mechanism 21 does not engage these stabilizing anchors. The first stabilizing anchor 25 is slidably engaged with the first stabilizing track 24, just as the second stabilizing anchor 27 is slidably engaged with the second stabilizing track 26. Potentially, similar to the riser for the anchoring member 23, a first stabilizing riser and second stabilizing riser can be connected between the height-adjustable platform 3 and supporting anchors, with the stabilizing risers being connected atop their respective supporting anchors. As result, in this embodiment, the height-adjustable platform's 3 weight is distributed across the anchoring member 23, the first stabilizing anchor 25, and the second stabilizing anchor 27. The supporting tracks, along with their respective anchors, thus provide additional support for the height-adjustable platform 3. This is in part due to better distribution of the load of the height-adjustable platform 3, with the ultimate result being improve resilience and reliability of the lift mechanism 2, height-adjustable platform 3, and present invention as a whole.

Though the drive mechanism 21 is not coupled to the first stabilizing anchor 25 or the second stabilizing anchor 27, said stabilizing anchors move up and down along their respective stabilizing tracks when the height-adjustable platform 3 is repositioned. Since the stabilizing anchors are connected to the height-adjustable platform 3, positional changes of the height-adjustable platform 3 result in corresponding positional changes of the stabilizing anchors. As the stabilizing anchors are slidably engaged to the stabilizing tracks, rather than being fixed, the stabilizing anchors are capable of moving along the stabilizing tracks.

In the illustrated embodiment, the anchoring member 23 traverses into the drive track 22, resulting in a telescoping connection. Similarly, the first stabilizing anchor 25 traverses into the first stabilizing track 24 while the second stabilizing anchor 27 traverses into the second stabilizing track 26. These connections can be direct or made through cuffs that join anchors to corresponding tracks. A telescoping connection is just one example of how the relation between the tracks and anchors can be further defined and does not preclude the use of other relations, such as open tracks, in other embodiments of the present invention.

The drive mechanism 21 is preferably electrically powered, such that it can be activated via an electrical connection to the power system 5. Different embodiments of the present invention may utilize different implementations of drive mechanisms 21. For example, hydraulics, gear systems, and pulley systems are a few examples of ways the anchor member 23 can be moved along the drive track 22. Ultimately, whatever means is chosen, it should be able to be powered by an electric motor. The drive mechanism 21 thus acts as an electric lift for the height-adjustable platform 3.

A platform controller may be electrically connected between the power system 5 and the drive mechanism 21. The platform controller serves as an interface that allows an attending physician to move the height-adjustable platform 3 to a desired position. The platform controller can be attached to the accessory-receiving mount 4 for easy access, or stored atop the base structure 1 when not in use.

To protect against potential failures of the lift mechanism 2, at least one manual locking mechanism 28 may be included. The manual locking mechanism 28 is connected to either or both of the stabilizing tracks and, when engaged, can prevent movement of the stabilizing anchors along the stabilizing tracks. This enables a person to directly raise and lower the height-adjustable platform 3, using the manual locking mechanism 28 to secure the height-adjustable platform 3 once in a desired position. As an example, the manual locking mechanism 28 may be embodied as a clamp which is engaged in order to prevent movement of the anchors and disengaged in order to allow movement of the anchors. Other implementations of manual locking mechanisms 28 remain possible under the scope of the present invention.

The lift mechanism 2 and the height-adjustable platform 3 create a work surface which is adaptable to meet the changing needs of attending physicians. In order to ensure that contents placed on the height-adjustable platform 3 (e.g. a newborn infant when used in a maternity ward), a barrier 8 may be provided for the height-adjustable platform 3. The barrier 8 is thus connected atop the height-adjustable platform 3, such that the barrier 8 is positioned around the height-adjustable platform 3. In the illustrated embodiment, the barrier 8 comprises a first railing 81 and a second railing 82 which are positioned opposite each other across the height-adjustable platform 3. The first railing 81 is connected along a first edge of the height-adjustable platform 3 while the second railing 82 is connected along a second edge of the height-adjustable platform 3. The first railing 81 and the second railing 82 help to prevent newborns or objects from sliding off the edges of the height-adjustable platform 3. The first railing 81 and second railing 82 additional provide easily grasped fixtures that enable an attending physician to more easily maneuver the present invention. Preferably, the first railing 81 and second railing 82 can be removed from the height-adjustable platform 3 in order to provide improve access to the height-adjustable platform 3. This is beneficial, for example, when an attending physician needs to perform surgical procedures directly on the height-adjustable platform 3; if the railings were left in place, they would impede the surgical procedure.

Potentially, the height-adjustable platform 3 comprises a latching mechanism which can be used to receive and secure a variety of attachments. For example, weighing of newborn infants is often desirable in maternity wards and it is thus beneficial to have convenient access to a scale. The latching mechanism allows a scale or other desired attachment to be secured to the height-adjustable platform 3 when needed. When not needed, the height-adjustable platform 3 can be left as is, reducing weight and bulk of the present invention.

As the present invention is designed with maternity care in mind, several beneficial components are included, such as the resuscitation system 7 and the vacuum system 6. The resuscitation system 7 provides a readily available means for helping newborns who are having issues with breathing while the vacuum system 6 allows a newborn infant to easily and quickly be cleaned.

The resuscitation system 7 comprises a first gas tank 71, a second gas tank 72, a gas mixer 73, and a gas control module 74. The first gas tank 71 and the second gas tank 72 are in fluid communication with the gas mixer 73. The gas mixer 73 combines gas supplied from the gas tanks, the ratio of which can be controlled by the gas control module 74. The specific gases stored in each gas tank is not restricted, though a combination of oxygen and medical gases is preferable. Potentially, additional gas tanks could be utilized to allow for a larger variety of gases to be combined via the gas mixer 73. Furthermore, the first gas tank 71 and the second gas tank 72 are adjustable with respect to height and angle. Not only can said gas tanks be moved along a vertical axis, they can also be rotated between a vertical orientation and angled orientation, with degree of rotation ranging from 0° to 75°. An on/off switch is provided for the gas tanks to allow them to be turned on or off as necessary.

The gas mixer 73 can output the combined gases through a breathing mask 75, or simply via an outlet 741 of the gas control module 74. The goal of both output implementations is to deliver the mixed gas to a newborn infant placed on the height-adjustable platform 3, when needed by an attending physician.

The vacuum system 6 comprises a vacuum pump 61 and a vacuum hose 62. The vacuum pump 61 is used to create suction, allowing the connected vacuum hose 62 to clean a newborn infant.

The power system 5 enables operation of the electrical components of the present invention. The power system 5 comprises a power source 51 and a housing 52, with the power source 51 being positioned within the housing 52. The housing 52 itself is connected to the base structure 1, ensuring that power is always available for the components of the present invention. The power source 51 itself is preferably a rechargeable battery, negating the need to replace the power source 51. To help users maintain awareness of remaining charge, a power remaining indicator 521 is mounted on the housing 52. The power remaining indicator 521 is electrically connected to the power source 51 in order to determine and display the remaining charge at any given time. To allow for recharging of the power source 51, a power port 522 traverses into the housing 52 where it is electrically connected with the power source 51. This allows an external source of power (e.g. from a power grid) to be connected to the power source 51 when recharging is needed.

The accessory-receiving mount 4 is provided to allow accessory devices such as modules and displays to easily be incorporated to the present invention. The aforementioned accessories can be attached to the accessory-receiving mount 4, where they are positioned to be easily viewed and accessed by an attending physician. In the illustrated embodiment, the gas control module 74 is an example of a component which is attached to the accessory-receiving mount 4. By attaching the gas control module 74 to the accessory-receiving mount 4, an attending physician is easily able to control the gas mixture via an interface of the gas control module 74. Effectively, the accessory-receiving mount 4 makes the gas control module 74 more convenient to operate. Examples of other accessories that can be attached to the accessory-receiving mount 4 include a timer, a heart rate monitor 42, and a respiration monitor. The timer can serve as a clock, simply displaying the current time, or be used to accurately measure intervals by counting up or counting down. The heart rate monitor 42 is connected to a bracket 41 positioned at the top of the accessory-receiving mount 4, the bracket being designed to accommodate the heart rate monitor 42. The heart rate monitor 42 and respiration monitor serve as displays that provide rapid visual feedback to an attending physician regarding the heartbeat and breathing of a newborn infant who is placed on the height-adjustable platform 3. The heart rate monitor 42 is provided with a power charger which is located besides the housing 52 of the power system 5. A portable x-ray unit 43 (such as the Diox 602 unit weighing 4.8 pounds) is another example of an accessory that can be provided with the present invention.

The accessory-receiving mount 4 is preferably adjustable, allowing an attending physician to reposition it as wanted. As the accessory-receiving mount 4 is not permanently connected to the height-adjustable platform 3, its position relative to the height-adjustable platform 3 can easily be adjusted by removing the accessory-receiving mount 4 from the height-adjustable platform 3 and reattaching said accessory-receiving mount 4 in the desired position. Preferably, the accessory-receiving mount 4 includes a first arm and a second arm which are perpendicularly connected to each other. The first arm is hingedly attached to the height-adjusting platform, allowing the first arm to rotate along a plane which is parallel to that of the height adjustable platform. The second arm is rotatably connected to the first arm, such that the second arm can rotate about its elongated axis. These connections provide more flexibility for attending physicians, who can rotate the first arm and second arm to better position attached accessories as needed. The attachment of said accessories can be such that further manipulation of the accessories is possible, e.g. rotating or tilting the attached accessories with respect to the accessory-receiving mount 4. Additional examples of accessories that can be provided for the present invention include, but are not limited to, an anesthetic monitor and an x-ray unit, potentially placed on the height-adjustable platform 3.

To allow the present invention to be easily moved, a plurality of wheels 9 is connected to the base structure 1 in one embodiment of the present invention. Each of the plurality of wheels 9 is pivotally connected to the base structure 1, allowing the wheel to rotate about a vertical axis. Unlike fixed wheels, the pivotally connected wheels allow the present invention to be moved in any direction; fixed wheels do not allow for rotation and thus limit movement to one direction. The limited range of motion makes small positional adjustments much more difficult. When the present invention is in use, for example a newborn infant is being examined on the height-adjustable platform 3, the present invention can be secured by locking the wheels in order to prevent undesired movement. As a few examples of alternative options, these wheels could instead be replaced with a 4" stainless steel base or with high standard wheels.

In the preferred embodiment, the heart rate monitor 42 is supplemented by a anesthesia monitor such as the Infinity 540 model produced by Draeger. The anesthesia monitor, similar to the heart rate monitor 42, is attached to the accessory-receiving mount 4. This model provides several benefits, including the ability to be detached from the accessory-receiving mount 4 with one hand, as well as instantaneous switching between wired and wireless networking; this allows the monitor to be held independently of the accessory-receiving mount 4 while still receiving relevant data via wireless transmission. In simpler terms, the accessory-receiving mount 4 acts as a docking station for this model of anesthesia monitor. Other desirable properties of the preferred model for the anesthesia monitor include a widescreen display, and the ability for the screen to automatically flip 180 degrees (such that it reminds "right-side up" no matter how a person holds it).

While different embodiments may use different materials for the construction of the present invention, materials which are sturdy, resistant to bacteria, and easy to clean are preferably. These qualities are especially valuable in hospital environments, which the present invention is intended for use in. An example of such a material is stainless steel, though the present invention is not limited to such and different embodiments may use other materials as part of the construction of the present invention.

Although the invention has been explained in relation to its preferred embodiment, it is to be understood that many other possible modifications and variations can be made without departing from the spirit and scope of the invention as hereinafter claimed.

What is claimed is:

1. An independent neonatal support assessment placenta transfusion and resuscitation unit comprising:

a base structure;

a lift mechanism;

a height-adjustable platform;

an accessory-receiving mount;

a power system;

a vacuum system;
a resuscitation system;
a barricade;
a plurality of wheels;
a first stabilizing mechanism;
a second stabilizing mechanism;
a portable x-ray unit;
the lift mechanism being connected to the base structure;
the first stabilizing mechanism being connected to the base structure;
the second stabilizing mechanism being connected to the base structure;
the height-adjustable platform being connected to the lift mechanism, the first stabilizing mechanism and the second stabilizing mechanism;
the lift mechanism being connected in between the height-adjustable platform and the base structure;
the first stabilizing mechanism being connected in between the height-adjustable platform and the base structure;
the second stabilizing mechanism being connected in between the height-adjustable platform and the base structure;
the accessory-receiving mount being attached to the height-adjustable platform;
the power system being mounted to the base structure;
the vacuum pump being mounted to the base structure;
the resuscitation system being mounted to the base structure and attached to the accessory-receiving mount;
the power system being electrically connected to the lift mechanism, the vacuum system, and the resuscitation system;
the barricade being connected to the height-adjustable platform;
the height-adjustable platform comprising a first edge, a second edge and an upper surface;
the first edge and the second edge being oppositely located to each other across the upper surface;
the barricade comprising a first railing and a second railing;
the first railing being connected along the first edge on the upper surface;
the second railing being connected along the second edge on the upper surface;
the resuscitation system comprising a first gas tank, a second gas tank, a gas mixer, a gas control module and a breathing mask;
the first gas tank being mounted to the base structure;
the second gas tank being mounted to the base structure;
the gas control module being attached to the accessory-receiving mount;
the first gas tank, the second gas tank and the gas control module each being in fluid communication with the gas mixer;
the breathing mask being in fluid communication with the gas control module;
the gas control module comprising an outlet;
the outlet being adjacently positioned to the height-adjustable platform;
the plurality of wheels being pivotally connected to the base structure;
the plurality of wheels being positioned below the base structure;
the vacuum system comprising a vacuum pump and a vacuum hose;
the vacuum pump being mounted to the base structure;
the vacuum hose being in fluid communication with the vacuum pump;
the lift mechanism comprising a drive mechanism, a drive track and an anchoring member;
the drive track being connected atop the base structure;
the anchoring member being slidably engaged with the drive track;
the height-adjustable platform being connected atop the anchoring member;
the anchoring member being actuated by the drive mechanism;
the anchoring member being movable along the drive track via the drive mechanism;
the first stabilizing mechanism comprising a first stabilizing track, a first stabilizing anchor and a first manual locking mechanism;
the first stabilizing anchor being slidably engaged with the first stabilizing track;
the height-adjustable platform being connected atop the first stabilizing anchor:
the first stabilizing track being parallel with the drive track;
the first stabilizing track being separate from the drive track;
the first manual locking mechanism being engaged with the first stabilizing track and the first stabilizing anchor;
the first manual locking mechanism being capable of preventing the first stabilizing anchor move along the first stabilizing track;
the second stabilizing mechanism comprising a second stabilizing track, a second stabilizing anchor and a second manual locking mechanism;
the second stabilizing anchor being slidably engaged with the second stabilizing track;
the height-adjustable platform being connected atop the second stabilizing anchor;
the second stabilizing track being parallel with the drive track;
the second stabilizing track being separate from the drive track;
the second manual locking mechanism being engaged with the second stabilizing track and the second stabilizing anchor;
the second manual locking mechanism being capable of preventing the second stabilizing anchor move along the second stabilizing track;
the drive track being located in between the first stabilizing track and the second stabilizing track;
the power system comprising a power source, a housing, a power remaining indicator and a power port;
the housing being mounted to the base structure;
the power source being positioned within the housing;
the power remaining indicator being mounted to the housing;
the power remaining indicator being electrically connected to the power source;
the power port traversing into the housing;
the power port being electrically connected to the power source;
the power source being a rechargeable battery;
the accessory-receiving mount comprising a first arm and a second arm;
the first arm being hingedly attached to the height-adjustable platform such that the first arm is capable of rotating along a plane which is parallel to the upper surface;

the first arm and the second arm being perpendicularly and rotatably connected to each other;

the portable x-ray unit being removably disposed on the second arm;

a bracket;

the bracket being attached to a top end of the second arm;

a monitor; and the monitor being mounted on the bracket.

* * * * *